US008482218B2

(12) United States Patent
Wang et al.

(10) Patent No.: US 8,482,218 B2
(45) Date of Patent: Jul. 9, 2013

(54) DIMMING INPUT SUITABLE FOR MULTIPLE DIMMING SIGNAL TYPES

(75) Inventors: Shiju Wang, Irvine, CA (US); Chien Nguyen, Huntington Beach, CA (US); Hwangsoo Choi, Fullerton, CA (US); Arkadiy Peker, Glen Cove, NY (US); Migel Jacubovski, Hod Hasharon (IL); Alon Ferentz, Bat Yam (IL); Dror Korcharz, Bat Yam (IL)

(73) Assignee: Microsemi Corporation, Aliso Viejo, CA (US)

( * ) Notice: Subject to any disclaimer, the term of this patent is extended or adjusted under 35 U.S.C. 154(b) by 298 days.

(21) Appl. No.: 13/017,128

(22) Filed: Jan. 31, 2011

(65) Prior Publication Data

US 2011/0187283 A1 Aug. 4, 2011

Related U.S. Application Data

(60) Provisional application No. 61/299,979, filed on Jan. 31, 2010.

(51) Int. Cl.
*H05B 37/02* (2006.01)

(52) U.S. Cl.
USPC ..... 315/291; 315/294; 315/307

(58) Field of Classification Search
USPC ..... 315/185 R, 291, 294, 297, 307–308, 315/312, 360, DIG. 4
See application file for complete search history.

(56) References Cited

U.S. PATENT DOCUMENTS

| | | | | |
|---|---|---|---|---|
| 5,339,009 | A | 8/1994 | Lai | |
| 6,281,640 | B1 * | 8/2001 | Kim | 315/291 |
| 7,019,577 | B2 | 3/2006 | Agrawal et al. | |
| 7,369,079 | B2 | 5/2008 | Maier | |
| 8,427,081 | B2 * | 4/2013 | Hsu | 315/360 |
| 2008/0150450 | A1 * | 6/2008 | Starr et al. | 315/294 |
| 2008/0308026 | A1 | 12/2008 | Shimizu et al. | |
| 2009/0037038 | A1 | 2/2009 | Mollet et al. | |
| 2009/0184662 | A1 * | 7/2009 | Given et al. | 315/294 |
| 2010/0301751 | A1 * | 12/2010 | Chobot et al. | 315/86 |
| 2011/0012530 | A1 * | 1/2011 | Zheng et al. | 315/294 |

* cited by examiner

*Primary Examiner* — Tung X Le
(74) *Attorney, Agent, or Firm* — Simon Kahn

(57) ABSTRACT

A lighting circuit constituted of: a single dimming input; a pulse width modulation acceptance circuit arranged to convert a pulse width modulated dimming signal received at the single dimming input into a local dimming signal, the local dimming signal exhibiting a predetermined format; an analog voltage level acceptance circuit arranged to convert an analog voltage dimming signal received at the single dimming input into the local dimming signal exhibiting the predetermined format; and a luminaire driving circuit responsive to the local dimming signal.

17 Claims, 5 Drawing Sheets

500

OUT+
80
80
570
640
LUMINAIRE DRIVER
630
STAGGER
PWM
620
PWM/ANALOG
610
FILTER
660
CONTROL
650
540
530
670
DUTY CYCLE
700
COMPARE
710
TRANSITION DETECT
720
TIMING
PWM DETECTION
600
510
SAWTOOTH GENERATOR
520
VCC
OFFSET
540
20
550
560
PWM
ANALOG INPUT
EXT

DIMMING INPUT SUITABLE FOR MULTIPLE DIMMING SIGNAL TYPES

CROSS-REFERENCE TO RELATED APPLICATION

This application claims priority from U.S. Provisional Patent Application Ser. No. 61/299,979 filed Jan. 31, 2010, entitled "Dimming Input Suitable for Multiple Dimming Signal Types", the entire contents of which are incorporated herein by reference.

TECHNICAL FIELD

The present invention relates to the field of lighting circuits and more particularly to a circuit arrangement allowing for a plurality of dimming type inputs to be connected to a single terminal of a lighting circuit.

BACKGROUND

Many lighting circuits enable a user, or an external control circuit, to provide a dimming signal. The lighting circuit is typically required to adjust the ultimate light intensity responsive to the dimming signal. Such light circuits are useful for both general lighting and backlighting applications, such as in monitors and televisions.

Unfortunately, there is no standard for dimming signals, and thus each system designer is free to select the dimming method of their choice. At present, there exists in wide use a few typical dimming signal types, without limitation:

a. An analog signal, whose value is representative of the desired dimming level, i.e. the signal may range over a plurality of values, with the highest value representing the maximum dimming, i.e. minimum luminance;
b. An analog signal, whose value is representative of the desired luminance, i.e. the signal may range over a plurality of values, with the highest value representing the minimum dimming, i.e. maximum luminance; and
c. A pulse width modulated (PWM) signal whose duty cycle represents the desired dimming level, with a duty cycle of 1 typically representing the maximum luminance.

It is to be noted that the above list is not meant to be limiting in any way, and other dimming schemes, including an AC signal whose average of the absolute value is representative of the desired luminance may be provided without exceeding the scope. The analog signal may be directly provided, or alternatively the lighting circuit may be required to provide a driving circuitry to be attached to a variable resistance, the variable resistance in cooperation with the driving circuitry thus providing the analog signal.

As a result a lighting circuit must be designed and inventoried for each potential dimming type, thus increasing cost. Alternately, a plurality of leads must be supplied for a signal lighting circuit, each of the plurality of leads associated with a target dimming type signal.

What is desired, and not supplied by the prior art, is a lighting circuit with a single dimming input lead suitable for use with multiple dimming type signals.

SUMMARY

In view of the discussion provided above and other considerations, the present disclosure provides methods and apparatus to overcome some or all of the disadvantages of prior and present lighting circuits. Other new and useful advantages of the present methods and apparatus will also be described herein and can be appreciated by those skilled in the art.

This is provided in certain embodiments by a lighting circuit exhibiting a single input suitable for a plurality of dimming type signals. The supplied dimming signal type is automatically detected and the luminance of an associated luminaire is controlled responsive to the received dimming signal.

Additional features and advantages of the invention will become apparent from the following drawings and description.

BRIEF DESCRIPTION OF THE DRAWINGS

For a better understanding of the invention and to show how the same may be carried into effect, reference will now be made, purely by way of example, to the accompanying drawings in which like numerals designate corresponding elements or sections throughout.

With specific reference now to the drawings in detail, it is stressed that the particulars shown are by way of example and for purposes of illustrative discussion of the preferred embodiments of the present invention only, and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice. In the accompanying drawings.

DETAILED DESCRIPTION OF PREFERRED EMBODIMENTS

Figure 1:
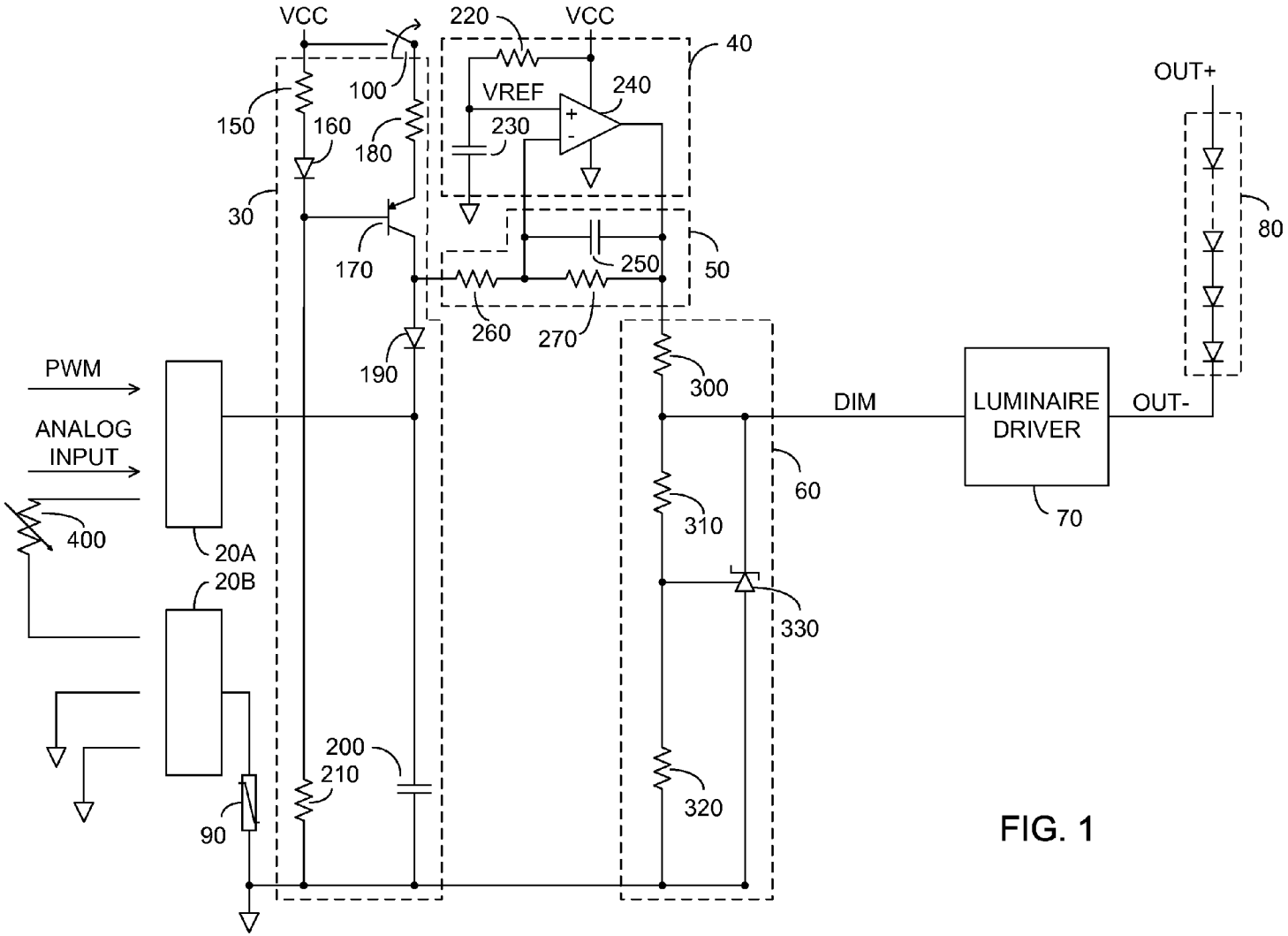
FIG. 1 illustrates a high level schematic diagram of a lighting circuit according to certain embodiments suitable for use with any of an analog input signal, a PWM dimming signal input and a variable resistance input, wherein a local analog dimming signal is developed.

Before explaining at least one embodiment in detail, it is to be understood that the invention is not limited in its application to the details of construction and the arrangement of the components set forth in the following description or illustrated in the drawings. The invention is applicable to other embodiments or of being practiced or carried out in various ways. Also, it is to be understood that the phraseology and terminology employed herein is for the purpose of description and should not be regarded as limiting. The term connected as used herein is not meant to be limited to a direct connection, and the use of appropriate resistors, capacitors and inductors does not exceed the scope thereof.

FIG. 1 illustrates a high level schematic diagram of a lighting circuit 10 according to certain embodiments suitable for use with any of an analog voltage dimming signal, a PWM dimming signal input and a variable resistance input, wherein a local analog dimming signal is developed. Lighting circuit 10 comprises: a single dimming input 20, illustrated as a pair of inputs 20A and 20B; a constant current circuit 30; an analog voltage acceptance circuit 40; a PWM signal acceptance circuit 50; a dimming range limitation circuit 60; a luminaire driver 70; a luminaire 80, illustrated without limitation as constituted of a string of LEDs; an over current protection device 90; and over temperature protection device 100. Constant current circuit 30 comprises a resistor 150, a diode 160, a PNP bipolar transistor 170, a resistor 180, a diode 190, a capacitor 200 and a resistor 210. Analog voltage acceptance circuit 40 comprises a resistor 220, a capacitor 230 and an operational amplifier 240. PWM signal acceptance circuit 50 comprises a capacitor 250, a resistor 260 and a resistor 270. Dimming range limitation circuit 60 comprises a resistor 300, a resistor 310, a resistor 320 and an adjustable precision shunt regulator 330. Single dimming input 20 may have alternately connected thereto a PWM dimming input signal, an analog dimming input signal and a variable resistance 400.

Variable resistance 400, if supplied is connected between input 20A and input 20B. In the event that a PWM dimming input signal is provided, the PWM dimming input signal is connected to input 20A and input 20B is connected to a common potential. In the event that an analog dimming input signal is provided, the analog dimming input signal is connected to input 20A and input 20B is connected to the common potential. Input 20B is connected to the first end of over current protection device 90 and the second of over current protection device 90 is connected to the common potential.

A first end of resistor 150 is connected to a voltage supply potential, denoted VCC, and a second end of resistor 150 is connected to the anode of diode 160. The cathode of diode 160 is connected to the base of PNP bipolar transistor 170 and to a first end of resistor 210. The second end of resistor 210 is connected to the common potential. A first end of resistor 180 is connected via over temperature protection device 100 to voltage supply potential VCC, and a second end of resistor 180 is connected to the emitter of PNP bipolar transistor 170. The collector of PNP bipolar transistor 170 is connected to the anode of diode 190 and to a first end of resistor 260. The cathode of diode 190 is connected to input 20A and to a first end of capacitor 200, and a second end of capacitor 200 is connected to the common potential.

A second end of resistor 260 is connected to the inverting input of operational amplifier 240, to a first end of capacitor 250 and to a first end of resistor 270. The non-inverting input of operational amplifier 240, representing a reference voltage, or alternatively connected to a reference voltage, is connected to a first end of resistor 220 and to a first end of capacitor 230. A second end of resistor 220 is connected to voltage supply potential VCC and a second end of capacitor 230 is connected to the common potential. The output of operational amplifier 240 is connected a second end of capacitor 250, to a second end of resistor 270 and to a first end of resistor 300. A second end of resistor 300 is connected to a first end of resistor 310, to the cathode of adjustable precision shunt regulator 330 and to the input of luminaire driver 70, and is denoted DIM. The output of luminaire driver 70, denoted OUT− is connected to the cathode end of luminaire 80, and the anode end of luminaire 80 is connected to a power source output, denoted OUT+. A second end of resistor 310 is connected to the control input of adjustable precision shunt regulator 330 and to a first end of resistor 320. The second end of resistor 320 is connected to the common potential, and the anode of adjustable precision shunt regulator 330 is connected to the common potential.

In operation, in the event that variable resistance 400 is connected between inputs 20A and 20B, constant current circuit 30 provides a constant current through variable resistance 400 developing a voltage across variable resistance 400 whose value reflects the value of the resistance of variable resistance 400. In particular, current flows through the series connection of resistor 150, diode 160 and resistor 210, with the value of the current being responsive to the value of VCC and the values of resistors 150, 210. The voltage at the emitter of PNP bipolar transistor 170 is approximately the same as the voltage at the anode of diode 160, since the forward voltage drop of the emitter base junction of PNP bipolar transistor 170 is approximately the same as the voltage drop across diode 160, and the current flowing through the collector of PNP bipolar transistor 170 is fixed by the value of resistors 150, 210 and the value of resistor 180, irrespective of the present resistance of variable resistor 400. The voltage developed across variable resistance 400 is reflected at the anode of diode 190, and presented via resistor 260 to the inverting input of operational amplifier 240.

Operational amplifier 240 is arranged to output a signal whose value is reflective of the relationship between the voltage developed across variable resistance 400 and VREF, which appears at the input of luminaire driver 70 via resistor 300, as local dimming signal DIM. Selection of the appropriate value for VREF thus converts the voltage developed across variable resistance 400 to a local dimming signal appropriate for use with luminaire driver 70.

Dimming range limitation circuit 60 is operative to clamp a maximum value for local dimming signal DIM. The maximum value for local dimming signal DIM is reflective of the respective values of resistors 310, 320.

In one particular non-limiting embodiment, luminaire driver 70 is arranged such that a higher value for local dimming signal DIM results in a reduced luminance, and thus dimming range limitation circuit 60 prevents dimming to below predetermined limits, where operation may not be stable or where visible flicker may result.

Over current protection device 90 advantageously adds protection in the event that inputs 20A, 20B are accidentally connected to a high voltage signal. Over temperature protection device 100 disables constant current circuit 30 in the event that a safe operating temperature has been exceeded.

In the event that an analog voltage dimming signal is present at input 20A, analog voltage acceptance circuit 40 operates as described above to reflect the analog voltage to the inverting input of operational amplifier 240, and thus local dimming signal DIM reflects the value of the analog input dimming signal converted to the appropriate range to control luminaire driver 70. Input 20B is not required, and is connected to the common potential. Selection of the appropriate value for VREF thus converts the analog dimming signal of a known range to a local dimming signal appropriate for use with luminaire driver 70.

Dimming range limitation circuit 60 is operative to clamp a maximum value for local dimming signal DIM. The maximum value for local dimming signal DIM is reflective of the respective values of resistors 310, 320.

In one particular non-limiting embodiment, when the analog dimming signal exhibits a maximum value, local dimming signal DIM is of a minimum value and luminaire driver 70 is arranged to provide the maximum luminance from luminaire 80. When the analog dimming signal exhibits a minimum value, local dimming signal DIM is of a maximum value and luminaire driver 70 is arranged to provide the minimum luminance from luminaire 80. As described above, optionally dimming range limitation circuit 60 prevents dimming to below predetermined limits, where operation may not be stable or where visible flicker may result.

In the event that a PWM dimming signal is present at input 20A, input 20B is not required and is connected to the common potential. Positive pulses of the PWM dimming signal appearing at input 20A are reflected across diode 190 and filtered by a low pass filter constituted of capacitor 250, resistor 260 and resistor 270, thus providing the average value of the PWM dimming signal at the output of operational amplifier 240. Thus local dimming signal DIM reflects the average value of the PWM input dimming signal converted to the appropriate range to control luminaire driver 70. Selection of the appropriate value for VREF and the values for the low pass filter of PWM acceptance circuit 50 thus converts the PWM dimming signal of a known frequency and variable duty cycle to a local dimming signal appropriate for use with luminaire driver 70.

Dimming range limitation circuit 60 is operative to clamp a maximum value for local dimming signal DIM. The maximum value for local dimming signal DIM is reflective of the respective values of resistors 310, 320.

In one particular non-limiting embodiment, when the PWM dimming signal exhibits a maximum duty cycle, local dimming signal DIM is of a minimum value and luminaire driver 70 is arranged to provide the maximum luminance from luminaire 80. When the PWM dimming signal exhibits a minimum duty cycle, local dimming signal DIM is of a maximum value and luminaire driver 70 is arranged to provide the minimum luminance from luminaire 80. As described above, optionally dimming range limitation circuit 60 prevents dimming to below predetermined limits, where operation may not be stable or where visible flicker may result.

Advantageously, the PWM signal received at single dimming input 20 may be an open collector signal. Further advantageously the voltage range of the PWM signal received at single dimming input 20 may exceed the value for VCC due to the operation of diode 190.

Figure 2:
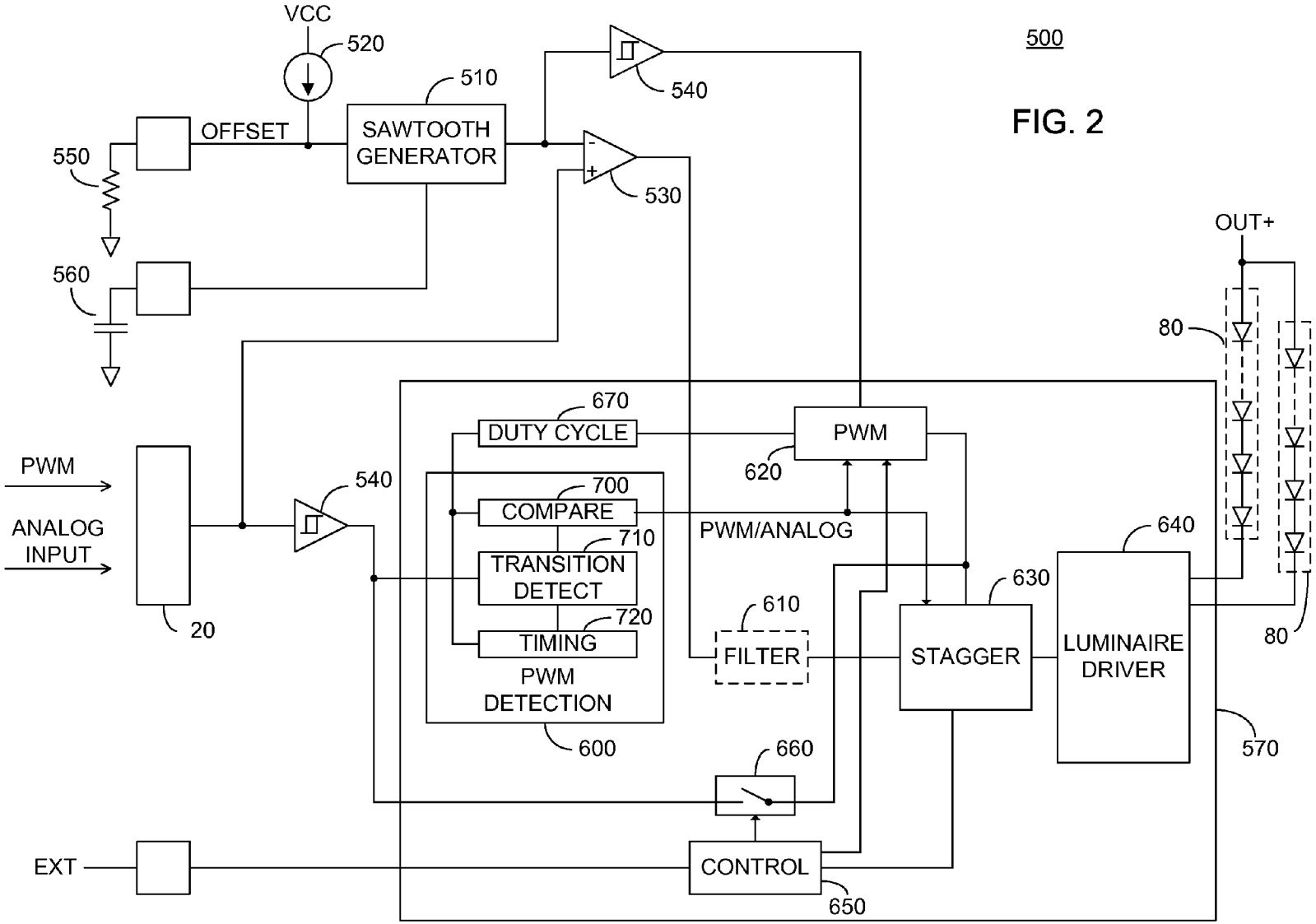
FIG. 2 illustrates a high level schematic diagram of a lighting circuit according to certain embodiments suitable for use with any of an analog input signal and a PWM dimming signal input, wherein a local PWM dimming signal is developed.

FIG. 2 illustrates a high level schematic diagram of a lighting circuit 500 according to certain embodiments suitable for use with any of an analog voltage dimming signal, a PWM dimming signal input and a variable resistance input, wherein a local PWM dimming signal is developed. Lighting circuit 500 comprises: a single dimming input 20; a saw tooth wave generator 510; a constant current circuit 520; a comparator 530; a first and a second Schmitt trigger buffer 540; a resistor 550; a capacitor 560; a digital PWM control portion 570; and a plurality of luminaires 80, illustrated without limitation as each constituted of a string of LEDs. Digital PWM control portion 570 comprises: a PWM detection circuit 600; an optional filter 610; a PWM generator 620; a staggering functionality 630; a luminaire driver 640; a control circuitry 650; an electronically controlled switch 660; and a duty cycle detection functionality 670. PWM detection circuit 600 comprises: a compare functionality 700; a transition detection functionality 710; and a timing functionality 720. Single dimming input 20 may have alternately connected thereto a PWM dimming input signal or an analog voltage dimming input signal. PWM detection circuit 600 may be implemented digitally as an embedded functionality without limitation.

Single dimming input 20 is connected to the input of first Schmitt trigger buffer 540 and to the non-inverting input of comparator 530. The output of first Schmitt trigger buffer 540 is connected to the input of transition detection functionality 710 and to a first end of electronically controlled switch 660. Resistor 550, illustrated as connected externally from lighting circuit 500 via a terminal connector, is connected between a common potential and the output of constant current source 520. The output of constant current source 520 is further connected to the input of saw tooth wave generator 510, and the input of constant current source 520 is connected to a voltage source potential, denoted VCC. Capacitor 560, illustrated as connected externally from lighting circuit 500 via a terminal connector, is connected between a common potential and an input of saw tooth wave generator 510. The output of saw tooth wave generator 510 is connected to the input of second Schmitt trigger buffer 540 and to the inverting input of comparator 530. The output of comparator 530 is connected to the input of optional filter 610 and the output of second Schmitt trigger buffer 540 is connected to an input of PWM generator 620.

Timing functionality 720 is in communication with transition detection functionality 710, with compare functionality 700 and with duty cycle detection functionality 670. Compare functionality 700 is further in communication with transition detection functionality 710. The output of compare functionality 700, denoted PWM/ANALOG, is connected to a control input of PWM generator 620 and to a selector input of staggering functionality 630. The output of duty cycle detection functionality 670 is connected to the input of PWM generator 620, and the output of PWM generator 620 is connected to a first input of staggering functionality 630 and to the second end of electronically controlled switch 660. The output of optional filter 610 is connected to a second input of staggering functionality 630. A first output of control circuitry 650 is connected to the control input of electronically controlled switch 660, a second output of control circuitry 660 is connected to a control input of PWM generator 620 and a third output of control circuitry 660 is connected to an input of staggering functionality 630. Control circuitry 660 is arranged to receive, or detect, an external control signal, denoted EXT. The output of staggering functionality 630 is connected to the input of luminaire driver 640 and the outputs of luminaire driver 640 are connected to a first end of a respective luminaire 80. A second end of each luminaire is connected to a power source, denoted OUT+.

In operation, saw tooth wave generator 510 generates a saw tooth waveform exhibiting a frequency responsive to the value of capacitor 560, and a voltage offset responsive to the value of resistor 550 and constant current circuit 520. PWM generator 620, responsive to the buffered output of saw tooth wave generator 510 generates a PWM signal, exhibiting a cycle frequency responsive to the value of capacitor 560. Comparator 530 is operative to compare the output of saw tooth wave generator 510 with the signal received at single dimming input 20, and in the event that the dimming input signal received at single dimming input 20 is an analog voltage dimming signal, output a local dimming signal as a PWM signal whose frequency is responsive to the value of capacitor 560 and whose duty cycle is responsive to the value of the analog voltage dimming signal. It is to be understood that the range of the analog voltage dimming signal is predetermined, and the value of the saw tooth waveform is to be selected accordingly.

The local PWM dimming signal output by comparator 530 is fed to optional filter 610, which is operative as will be described further below, to filter out noise riding on the analog voltage dimming signal received at single dimming input 20. The output of optional filter 610 is fed to the input of staggering functionality 630, which is operative to generate a plurality of time staggered PWM signals responsive to the received local, and optionally filtered, PWM dimming signal. Luminaire driver 640 is operative to drive each luminaire 80 at a pulsed constant current responsive to the respective time staggered, and optionally filtered local PWM dimming signal. In the event that the meaning of the analog voltage dimming signal may be reversed, i.e. that a lower voltage is indicative of a desired greater brightness, preferably control circuitry 650 is arranged to control staggering functionality 630 to reverse the meaning of the generated local PWM dimming signal. Preferably, PWM generator 620 is not operative unless an active PWM/ANALOG signal is received from compare functionality 700.

In the event that a PWM dimming signal is received at single dimming input 20, the PWM signal is buffered by first Schmitt trigger buffer 540 and passed to transition detection functionality 710 of PWM detection circuit 600. In general, PWM detection circuit 600 is operative to detect the presence of a PWM dimming signal at single dimming input 20 and output an active PWM/ANALOG signal upon detection of a PWM dimming signal exhibiting a duty cycle within a predetermined range. In greater detail, and as will be explained further below, each positive going transition, and each negative going transition, of the buffered received PWM dimming signal is detected by transition detection functionality 710, and the timing between consecutive transitions is determined in cooperation with timing functionality 720, and stored in timing functionality 720 associated with an identifier of the transition. Compare functionality 700 is operative to determine, particularly responsive to consecutive like transitions, either positive going or negative going, if over a plurality of consecutive PWM cycles the timing remains within the range, and in the event that over a plurality of consecutive PWM cycles the timing remains within the range, output an active PWM/ANALOG signal.

Duty cycle functionality 670 is operative to detect the duty cycle of the received PWM dimming signal and output a signal representative of the duty cycle, which output signal is received at PWM generator 620. Duty cycle functionality 670 is particularly responsive to both positive going transitions and negative going transitions determined by, and stored on, timing functionality 720, to determine the duty cycle.

PWM generator 620 is arranged to generate a PWM signal, whose duty cycle is responsive to the signal output by duty cycle detection functionality 670 and whose frequency is responsive to the value of capacitor 560, provided that an active PWM/ANALOG signal is received. In the absence of an active PWM/ANALOG signal, PWM generator 620 preferably does not output a PWM signal, and further preferably exhibits a high impedance output.

Staggering functionality 630 is provided with two alternate inputs. A first input is received from the junction between the output of PWM generator 620 and the second end of electronically controlled switch 660, and a second input is received from the output of optional filter 610. Staggering functionality 630 selects the input responsive to the state of the PWM/ANALOG signal. In particular, when an active PWM/ANALOG signal is present, staggering functionality 630 passes the input received from PWM generator 620. When an inactive PWM/ANALOG signal is present, staggering functionality 630 passes the input received from the output of optional filter 610. In an alternative embodiment (not shown), a separate multiplexer is supplied at the input to staggering functionality 630, the separate multiplexer being responsive to the PWM/ANALOG signal. Staggering functionality 630 and luminaire driver 640 are operative as described above to drive luminaires 80 with a constant current PWM signal.

Responsive to a predetermined EXT signal, control circuitry 650 is operative to disable PWM generator 620, thus setting its output to a high impedance state, and close electronically controlled switch 660. In such a condition, the received PWM signal is passed directly to staggering functionality 630 and ultimately to luminaire driver 640 to drive luminaires 80. Electronically controlled switch 660, when opened, preferably exhibits a high impedance towards the output of PWM generator 620. Signal EXT may be a digital signal, a downloaded command, or a decoded 1 or more resistor values without exceeding the scope. In one embodiment, the meaning of the received analog PWM dimming signal, i.e. whether a high value is equal to more dimming or more luminance, is further provided by signal EXT.

Figure 3:
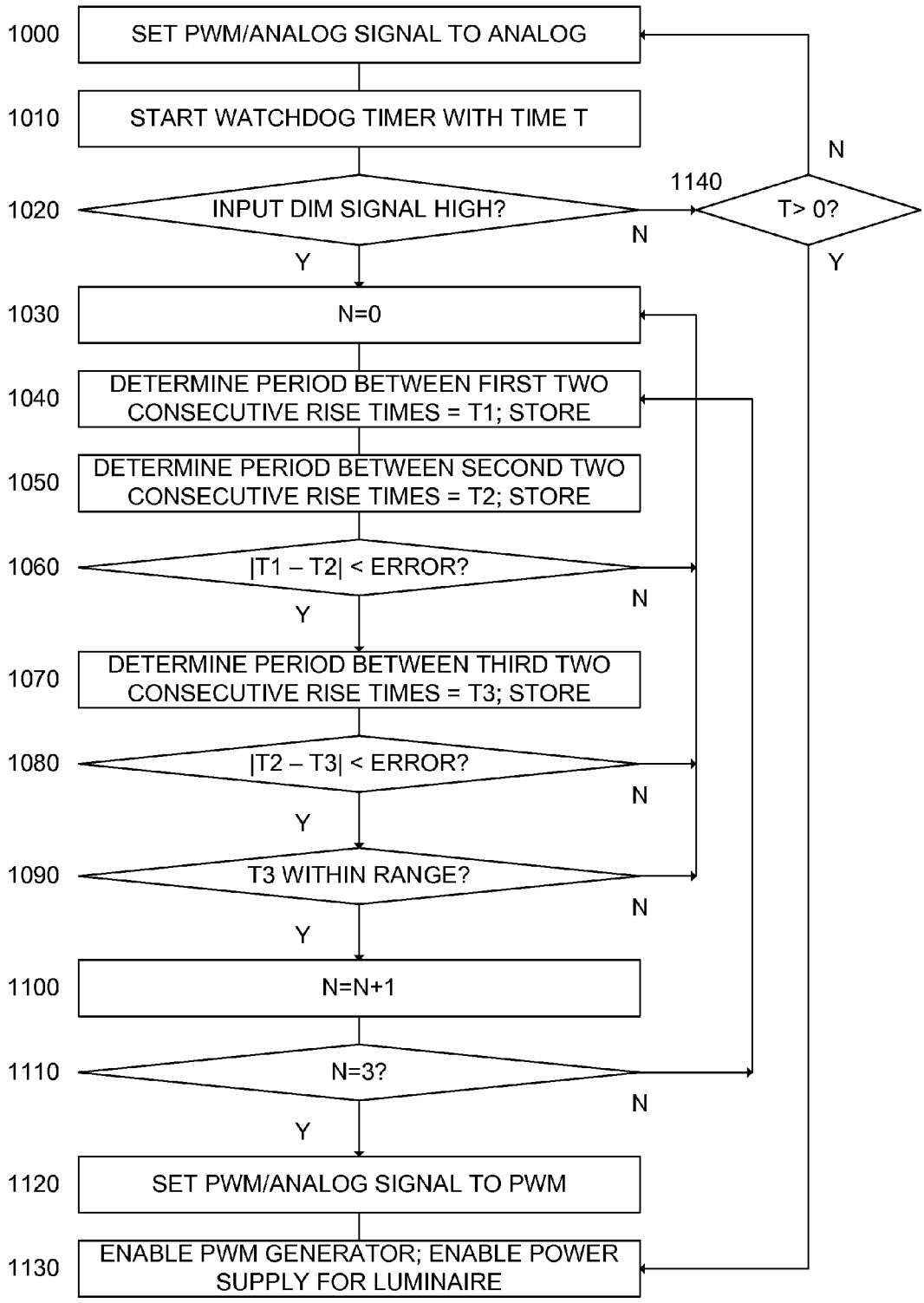
FIG. 3 illustrates a high level flow chart of the operation of the PWM detection functionality of FIG. 2 according to certain embodiments.

FIG. 3 illustrates a high level flow chart of the operation of PWM detection circuit 600 of FIG. 2 according to certain embodiments. In stage 1000, at initialization, the PWM/ANALOG signal is set to analog, i.e. in the absence of a positive finding of an input PWM dimming signal, the input signal is assumed to be an analog voltage dimming signal. In stage 1010 a watchdog timer, loaded with a predetermined time T is started. In one embodiment, the watchdog timer is set to time period T, and an interrupt is sent when the watchdog timer runs out.

In stage 1020, the input signal received at transition detection functionality 710 is compared with a high level. In the event that the input signal received from first Schmitt trigger buffer 540 is high, in stage 1030 a counter, denoted N, is initialized to zero. In stage 1040, the period between the first two consecutive detected rise times of the input signal is determined and saved as time T1. In stage 1050, the period between the second two consecutive detected rise times of the input signal is determined and saved as time T2. In an exemplary embodiment, T1 and T2 are determined by, and stored in, timing functionality 720.

In stage 1060, the absolute value of the difference between T1 and T2 is compared with an error value, denoted ERROR. The value for ERROR is preferably selected so as to discriminate between a valid PWM signal and random noise, responsive to any clock sampling skew. In the event that the absolute value of the difference between T1 and T2 is not less than ERROR, stage 1030 as described above, is again performed. In the event that the absolute value of the difference between T1 and T2 is less than ERROR, i.e. the signal appears to be a valid PWM signal, in stage 1070, the period between the third two consecutive detected rise times of the input signal is determined and saved as time T3. In an exemplary embodiment, T3 is determined by, and stored in, timing functionality 720.

In stage 1080, the absolute value of the difference between T2 and T3 is compared with error value ERROR. In the event that the absolute value of the difference between T2 and T3 is not less than ERROR, stage 1030 as described above, is again performed. In the event that the absolute value of the difference between T2 and T3 is less than ERROR, i.e. the signal appears to be a valid PWM signal, in stage 1090 the value of T3 is compared with the allowed predetermined range for PWM signals. Thus, if T1, T2, and T3 are consistent within the value of ERROR, the PWM cycle time represented by T3 is compared with the allowed predetermined range of PWM signal. In the event that in stage 1090 T3 is not within the predetermined range, stage 1030 as described above is performed. In an alternative embodiment, not shown, stage 1130 described further below is performed. In the event that T3 is within the predetermined range, in stage 1100 counter N is incremented. Counter N determines the number of times that the loop is performed, wherein each loop measures 3 consecutive intervals.

In stage 1110, the current value for counter N is compared with the target value of the number of times the loop is to be performed, for simplicity herein set at 3, however more or less than 3 may be selected without exceeding the scope. Similarly, stages 1040-1080 are arranged to determine the time difference between four consecutive positive going transitions, however this is not meant to be limiting in any way, and more or less transactions may be determined without exceeding the scope. In the event that N is not equal to 3, stage 1040, as described above is performed. Thus, in the event that N is not equal to 3 an additional set of positive going transitions will be compared to determine that their differences are less than ERROR and that the value is within the predetermined allowed range.

In the event that in stage 1110 N is equal to 3, in stage 1120 the PWM/ANALOG signal is set to PWM, thus in an exemplary embodiment enabling PWM generator 620, and in stage 1130 a power supply for luminaires 80 is enabled. In an alternative embodiment, a separate enabling command is sent to PWM generator 620 as part of stage 1130.

In the event that in stage 1020 the input dim signal is not high, in stage 1140 the status of the watchdog timer is checked. In the event that time T has not expired, stage 1000 is performed. In the event that time T has expired, stage 1130 as described above is performed.

Thus, the operation of PWM detection circuit 600 is operative to detect a consistent PWM input signal and output a signal indicative of successful detection.

Figure 4:
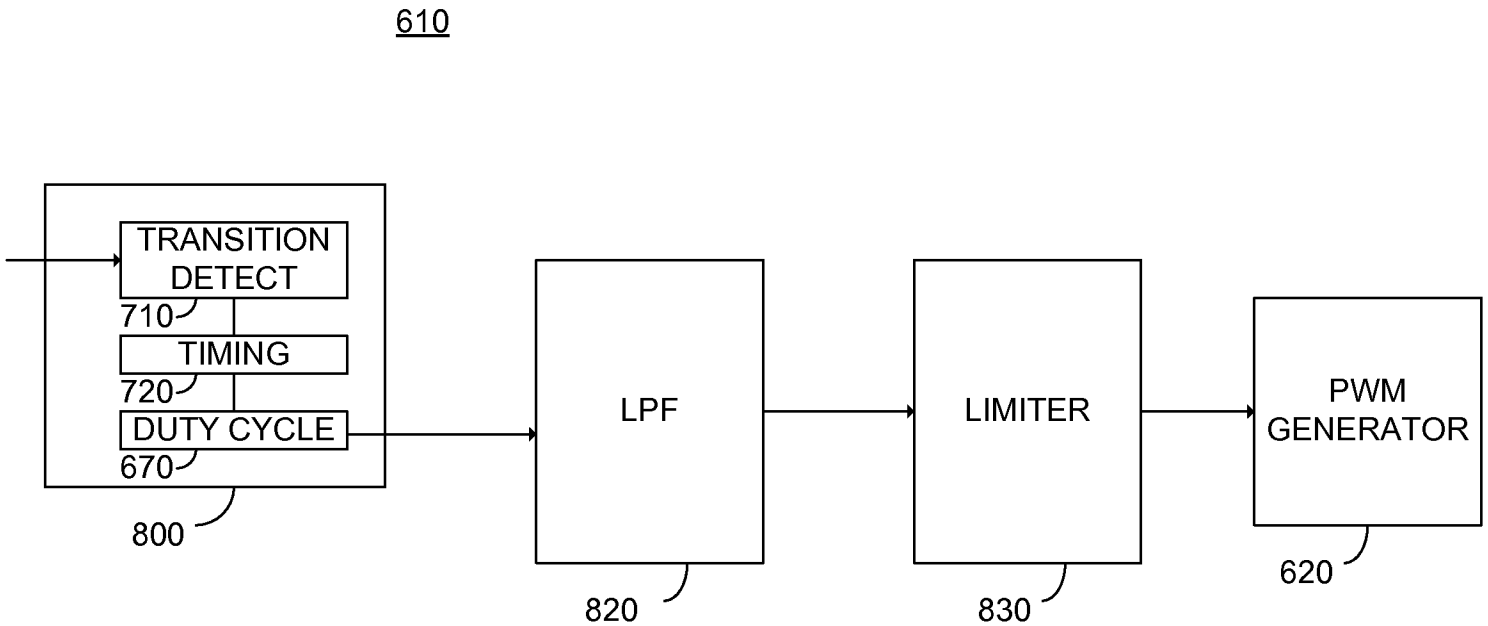
FIG. 4 illustrates a functional block diagram of the optional filter of FIG. 2 according to certain embodiments.

FIG. 4 illustrates a functional block diagram of optional filter 610 of FIG. 2 according to certain embodiments comprising: a PWM value determining functionality 800 comprising a transition detection functionality 710, a timing functionality 720 and duty cycle determining functionality 670; a low pass filter functionality 820; and a limiter functionality 830. PWM generator 620 is further illustrated for clarity. The input local dimming signal is received at transition detection functionality 710, and transition detection functionality 710 is communication with timing functionality 720. Timing functionality 720 is further in communication with duty cycle determining functionality 670, and the output of duty cycle determining functionality 670 is connected to the input of low pass filter functionality 820. The output of low pass filter functionality 820 is connected to the input of limiter functionality 830 and the output of limiter functionality 830 is connected to the input of PWM generator 620.

In operation, a received local dimming signal, having a PWM signal type, is received at transition detection functionality 710 of PWM value determining functionality 800. The combination of transition detection functionality 710, timing functionality 720 and duty cycle determining functionality 670 is operative as described above in relation to FIG. 2, and the output of duty cycle determining functionality 670 is thus a duty cycle value, typically a 15 or 16 bit digital value. Low pass filter functionality 820 is operative to only pass slow changes in the signal so as to filter out high frequency changes typically associated with noise. In one particular embodiment, the transfer function of low pass filter functionality 820 is operative as an infinite impulse response filter.

Limiter functionality 830 is operative to ignore changes of less than a first threshold, denoted THRESHOLD1, and for changes that are greater than THRESHOLD1 and less than a second threshold, denoted THRESHOLD2, smooth changes fed to PWM generator 620. In an exemplary embodiment THRESHOLD1 is a single least significant bit, and THRESHOLD2 is 1 bit greater than THRESHOLD1. For changes greater than THRESHOLD1 and less than THRESHOLD2, the value passed to PWM generator 620 is incremented, or decremented, by a single least significant bit for each PWM cycle. For changes greater than THRESHOLD2, the changed value is immediately passed to PWM generator 620. Thus, noise resulting from PWM value determining functionality 800 is filtered out, and not seen by PWM generator 620 or staggering functionality 630, as described above in relation to FIG. 2.

Figure 5:
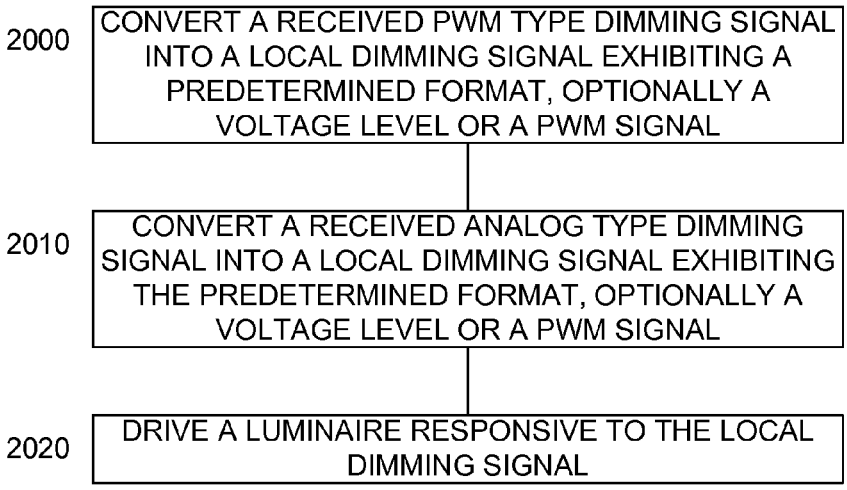
FIG. 5 illustrates a high level flow chart of a method of lighting according to certain embodiments, wherein a local analog dimming signal is developed.

FIG. 5 illustrates a high level flow chart of a method of lighting according to certain embodiments, wherein a local dimming signal is developed. In stage 2000, a received PWM type dimming signal is converted into a local dimming signal exhibiting a predetermined format. Optionally, the predetermined format is one of a voltage level, such as an analog voltage level, and a PWM signal. In stage 2010, a received analog voltage type dimming signal is converted into a local dimming signal exhibiting a predetermined format. Optionally, the predetermined format is one of a voltage level, such as an analog voltage level, and a PWM signal. In stage 2020, a luminaire is driven responsive to the local dimming signal of stages 2000 and 2010, respectively.

Figure 6:
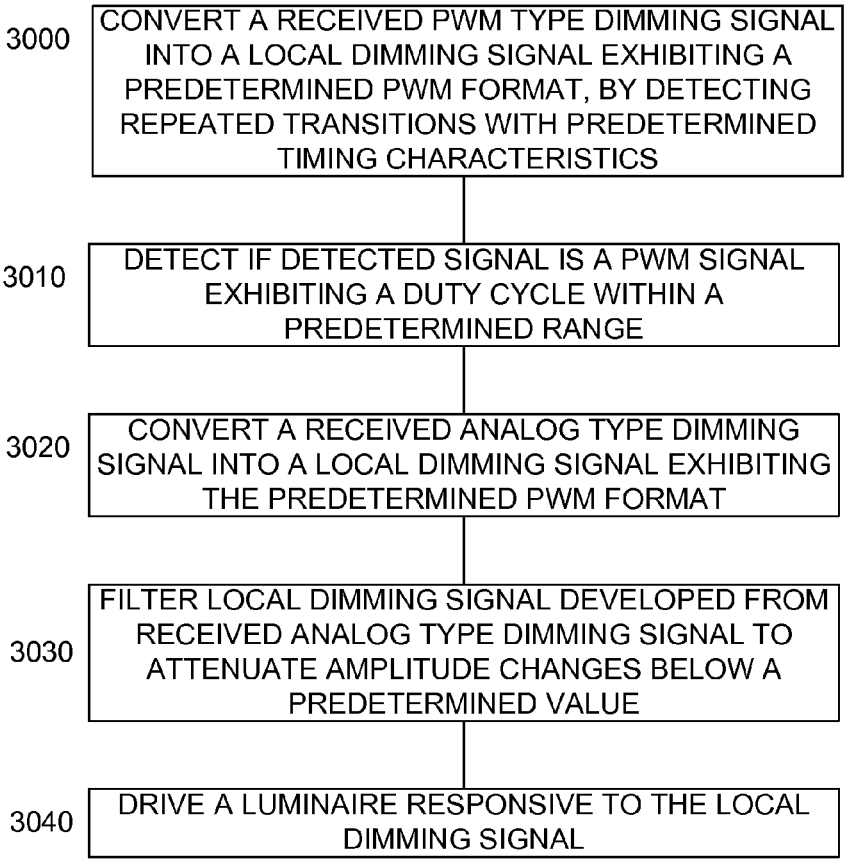
FIG. 6 illustrates a high level flow chart of a method of lighting according to certain embodiments, wherein a local PWM dimming signal is developed.

FIG. 6 illustrates a high level flow chart of a method of lighting according to certain embodiments, wherein a local PWM dimming signal is developed. In stage 3000, a received PWM type dimming signal is converted into a local dimming signal exhibiting a predetermined PWM format, preferably by detecting repeated like signal transitions within predetermined timing characteristics. In stage 3010, the received signal is identified as a PWM type dimming signal which exhibits a duty cycle within a predetermined range. In the event that it does not exhibit a duty cycle within a predetermined range, in one embodiment, the PWM type dimming signal is treated as an analog signal.

In stage 3020 a received analog voltage type dimming signal is converted into a local dimming signal exhibiting a predetermined PWM format. In stage 3030 the local dimming signal is filtered to attenuate amplitude changes below a predetermined value. In stage 3040 a luminaire is driven responsive to the local dimming signal of stages 3000 and 3020, respectively.

It is appreciated that certain features of the invention, which are, for clarity, described in the context of separate embodiments, may also be provided in combination in a single embodiment. Conversely, various features of the invention which are, for brevity, described in the context of a single embodiment, may also be provided separately or in any suitable subcombination.

Unless otherwise defined, all technical and scientific terms used herein have the same meanings as are commonly understood by one of ordinary skill in the art to which this invention belongs. Although methods similar or equivalent to those described herein can be used in the practice or testing of the present invention, suitable methods are described herein.

All publications, patent applications, patents, and other references mentioned herein are incorporated by reference in their entirety. In case of conflict, the patent specification, including definitions, will prevail. In addition, the materials, methods, and examples are illustrative only and not intended to be limiting.

It will be appreciated by persons skilled in the art that the present invention is not limited to what has been particularly shown and described hereinabove. Rather the scope of the present invention is defined by the appended claims and includes both combinations and subcombinations of the various features described hereinabove as well as variations and modifications thereof which would occur to persons skilled in the art upon reading the foregoing description and which are not in the prior art.

We claim:

1. A lighting circuit comprising:

a single dimming input;

a pulse width modulation acceptance circuit arranged to convert a pulse width modulated dimming signal received at said single dimming input into a local dimming signal, said local dimming signal exhibiting a predetermined format;

an analog voltage acceptance circuit arranged to convert an analog voltage dimming signal received at said single dimming input into said local dimming signal exhibiting the predetermined format;

a constant current circuit coupled to said single dimming input; and a luminaire driving circuit responsive to said local dimming signal, wherein in the event that a variable resistance is connected to said single dimming input, the analog voltage dimming signal is developed across the variable resistance responsive to said constant current circuit.

2. The lighting circuit of claim 1, wherein said luminaire driving circuit is arranged to drive at least one LED string.

3. The lighting circuit of claim 1, wherein said predetermined format is a voltage level.

4. The lighting circuit of claim 1, wherein said predetermined format is a pulse width modulated signal.

5. A lighting circuit comprising:

a single dimming input;

a pulse width modulation acceptance circuit arranged to convert a pulse width modulated dimming signal received at said single dimming input into a local dimming signal, said local dimming signal exhibiting a predetermined format;

a pulse width modulation detection circuit arranged to detect if a pulse width modulated signal exhibiting a duty cycle within a predetermined range appears on said single dimming input;

an analog voltage acceptance circuit arranged to convert an analog voltage dimming signal received at said single dimming input into said local dimming signal exhibiting the predetermined format; and a luminaire driving circuit responsive to said local dimming signal, wherein said pulse width modulation detection circuit comprises:

a timing functionality;

a transition detection functionality arranged to detect the transition of a signal; and a compare functionality, said compare functionality arranged to determine, in cooperation with said timing functionality, whether said detected transitions occur repeatedly within a predetermined frequency range, thereby detecting that a pulse width modulated signal exhibiting a duty cycle within a predetermined range appears on said single dimming input.

6. The lighting circuit of claim 5, wherein said analog voltage acceptance circuit comprises a saw tooth wave generator and a comparator in communication with the output of said saw tooth wave generator, said comparator outputting said local dimming signal as a pulse width modulated signal.

7. The lighting circuit of claim 5, further comprising:

a filter arranged to attenuate amplitude changes below a predetermined level from said local dimming signal, wherein said filter is arranged to filter said local dimming signal only in the event that said pulse width modulation detection circuit does not detect that a pulse width modulated signal exhibiting a duty cycle within the predetermined range appears on said single dimming input, the output of said filter in communication with said driving circuit.

8. The lighting circuit of claim 7, wherein said amplitude attenuation of said filter comprises:

prevent changes to said local dimming signal of less than a predetermined number of low order digital bits from one pulse width modulation cycle to the next.

9. The lighting circuit of claim 5, further comprising a bypass path, the lighting circuit operative responsive to an external input signal to pass the signal received at said single dimming input to said luminaire driving circuit, said luminaire driving circuit driving a luminaire responsive to said external input signal.

10. A lighting circuit comprising:

a single dimming input;

a pulse width modulation acceptance circuit arranged to convert a pulse width modulated dimming signal received at said single dimming input into a local dimming signal, said local dimming signal exhibiting a predetermined format;

an analog voltage acceptance circuit arranged to convert an analog voltage dimming signal received at said single dimming input into said local dimming signal exhibiting the predetermined format;

a luminaire driving circuit responsive to said local dimming signal; and a staggering functionality, arranged to produce a plurality of time staggered local dimming signals, said luminaire driving circuit arranged to drive a plurality of luminaires each with a particular one of said time staggered dimming signals.

11. A method of lighting responsive to receipt of one of a plurality of types of dimming signals at a single input, the method comprising:

converting a received pulse width modulated type dimming signal into a local dimming signal, said local dimming signal exhibiting a predetermined format;

converting a received analog voltage type dimming signal into the local dimming signal exhibiting the predetermined format;

providing a constant current circuit coupled to a dimming input terminal; and driving a luminaire responsive to said local dimming signal, wherein in the event that a variable resistance is connected to the dimming input terminal, the analog voltage type dimming signal is received responsive to said provided constant current circuit cooperating with the variable resistance.

12. The method of claim 11, wherein said predetermined format is a voltage level.

13. The method of claim 11, wherein said predetermined format is a pulse width modulated signal.

14. The method of claim 11, further comprising:

detecting if a dimming signal at the single input is a pulse width modulated type signal exhibiting a duty cycle within a predetermined range.

15. A method of lighting responsive to receipt of one of a plurality of types of dimming signals at a single input, the method comprising:

converting a received pulse width modulated type dimming signal into a local dimming signal, said local dimming signal exhibiting a predetermined format;

converting a received analog voltage type dimming signal into the local dimming signal exhibiting the predetermined format;

detecting if the dimming signal at the single input is a pulse width modulated type signal exhibiting a duty cycle within a predetermined range; and driving a luminaire responsive to said local dimming signal, wherein said detecting comprises:

detecting a plurality of transitions of a signal from one state to another; and determining whether said detected plurality of transitions occur repeatedly within a predetermined frequency range.

16. A method of lighting responsive to receipt of one of a plurality of types of dimming signals at a single input, the method comprising:

converting a received pulse width modulated type dimming signal into a local dimming signal, said local dimming signal exhibiting a predetermined format;

converting a received analog voltage type dimming signal into the local dimming signal exhibiting the predetermined format;

detecting if a dimming signal at the single input is a pulse width modulated type signal exhibiting a duty cycle within a predetermined range;

driving a luminaire responsive to said local dimming signal; and attenuating, only in the event that said dimming signal at the single input is detected the pulse width modulated type signal exhibiting the duty cycle within the predetermined range, amplitude changes below a predetermined level from said local dimming signal, wherein said driving the luminaire is responsive to said local dimming signal with said attenuated amplitude changes.

17. The method of claim 16, wherein said attenuating of said amplitude changes comprises:

preventing changes to said local dimming signal of less than a predetermined number of low order digital bits from one pulse width modulation cycle to the next.

* * * * *